US012098662B2

(12) United States Patent
Karic

(10) Patent No.: US 12,098,662 B2
(45) Date of Patent: Sep. 24, 2024

(54) CAMSHAFT ADJUSTER

(71) Applicant: Schaeffler Technologies AG & Co. KG, Herzogenaurach (DE)

(72) Inventor: Branimir Karic, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 196 days.

(21) Appl. No.: 17/780,041

(22) PCT Filed: Sep. 2, 2020

(86) PCT No.: PCT/DE2020/100767
§ 371 (c)(1),
(2) Date: May 26, 2022

(87) PCT Pub. No.: WO2021/104557
PCT Pub. Date: Jun. 3, 2021

(65) Prior Publication Data

US 2022/0412234 A1 Dec. 29, 2022

(30) Foreign Application Priority Data

Nov. 28, 2019 (DE) ..... 10 2019 132 228.6

(51) Int. Cl.
*F01L 1/344* (2006.01)

(52) U.S. Cl.
CPC ..... *F01L 1/3442* (2013.01); *F01L 1/344* (2013.01); *F01L 2001/34426* (2013.01); *F01L 2001/3445* (2013.01); *F01L 2001/34453* (2013.01)

(58) Field of Classification Search
CPC ... F01L 2001/34426; F01L 2001/34453; F01L 1/3442
See application file for complete search history.

(56) References Cited

U.S. PATENT DOCUMENTS

| | | | |
|---|---|---|---|
| 5,056,477 | A | 10/1991 | Linder et al. |
| 2008/0115751 | A1 | 5/2008 | Knecht et al. |
| 2012/0318221 | A1 | 12/2012 | Scheidig |
| 2013/0233261 | A1 | 9/2013 | Watanabe |
| 2014/0116365 | A1 | 5/2014 | Scheidig |
| 2016/0053640 | A1 | 2/2016 | Schafer et al. |

(Continued)

FOREIGN PATENT DOCUMENTS

| | | | |
|---|---|---|---|
| CN | 103670573 | A | 3/2014 |
| DE | 102010005604 | A1 | 7/2011 |
| DE | 102010022896 | A1 | 12/2011 |

(Continued)

*Primary Examiner* — Ngoc T Nguyen

(57) ABSTRACT

The disclosure relates to a vane type camshaft adjuster for a motor vehicle drive train. The camshaft adjuster having a stator, a rotor arranged such that it can rotate relative to the stator, working chambers formed between the stator and the rotor, each working chamber being divided into two sub-chambers by a radially projecting blade of the rotor, and a reservoir connected to the sub-chambers for storing hydraulic medium. The sub-chambers can be connected to a pump or a tank according to a switch position of a control valve of the camshaft adjuster. The control valve has a switch position in which a first sub-chamber of the two sub-chambers is connected to the tank and a second sub-chamber of the two sub-chambers is blocked from the pump.

20 Claims, 3 Drawing Sheets

(56) References Cited

U.S. PATENT DOCUMENTS

2018/0355767 A1 12/2018 Boese et al.

FOREIGN PATENT DOCUMENTS

| | | | | | |
|---|---|---|---|---|---|
| DE | 102016204973 | A1 | | 9/2017 | |
| DE | 102016218448 | A1 | | 3/2018 | |
| DE | 102017115725 | A1 | | 5/2018 | |
| DE | 102018109182 | A1 | | 10/2019 | |
| DE | 102022110573 | A1 | * | 11/2022 | ..... F01L 1/3442 |
| JP | 2013068308 | A | | 4/2013 | |
| WO | 2014173399 | A1 | | 10/2014 | |

* cited by examiner

CAMSHAFT ADJUSTER

CROSS-REFERENCE TO RELATED APPLICATIONS

This application is the U.S. National Phase of PCT Application No. PCT/DE2020/100767 filed on Sep. 2, 2020, which claims priority to DE 10 2019 132 228.6 filed on Nov. 28, 2019, the entire disclosures of which are incorporated by reference herein.

TECHNICAL FIELD

The disclosure relates to a hydraulic camshaft adjuster of the vane type for adjusting the phase position of a camshaft relative to a crankshaft for a motor vehicle drive train.

BACKGROUND

Such camshaft adjusters of the vane type are already known from the background of the art. The alternating torques acting on the camshaft can be used to adjust the angle of rotation of the camshaft, which is also referred to as a camshaft torque actuated (CTA) camshaft adjuster. In this case, the hydraulic medium is passed from one sub-chamber by means of the alternating torques acting on the camshaft via a bypass into the respective other sub-chamber. Alternatively or additionally, an external hydraulic medium supply, such as a pump, can be used to adjust the angle of rotation of the camshaft, which is also referred to as an oil pressure actuated (OPA) camshaft adjuster. In this case, one sub-chamber is pressurized by the hydraulic medium supply and the other sub-chamber is connected to a pressureless tank/reservoir for the discharge of hydraulic medium.

The advantage of performing an adjustment via the camshaft torques is that only a very small flow of hydraulic medium is required, namely to compensate for the leakage between the sub-chambers and the camshaft adjuster. However, adjustment via the camshaft torques is only possible if the alternating torques acting on the camshaft are sufficiently large, since the adjustment speeds that can be achieved at low alternating torques are too low.

The advantage of performing an adjustment via the oil pressure is that the adjustment can be easily controlled even with small adjustment shifts at low adjustment speeds. However, a relatively large flow of hydraulic medium, which must be supplied via the external hydraulic medium supply, is required, which has a negative effect on the necessary installation space.

To avoid the disadvantages of the two types of adjustment (OPA and CTA), so-called smartphasers have been developed, the main advantage of which is that they combine the principles of OPA and CTA adjustment in order to ensure higher adjustment speeds with reduced quantities of hydraulic medium.

Such a camshaft adjuster is known, for example, from DE 10 2010 005 604 A1. This publication discloses a pressure medium-actuated camshaft adjusting device for an internal combustion engine, with at least two oppositely acting working chambers, a pressure medium pump, a pressure medium reservoir and a multi-way valve. The multi-way valve includes a housing with several openings assigned to the working chambers, the pressure medium pump and the pressure medium reservoir through which an inflow and/or outflow of a pressure medium is facilitated, a valve body which is displaceably guided within the housing between two end positions and which, depending on the position, with control edges resting on the housing, blocks or enables the flow of the pressure medium through the openings in the housing, and a double check valve arranged in the valve body enabling a flow of the pressure medium in two different directions. The control edges are arranged in such a way that, in the end positions of the valve body, the double check valve facilitates a flow of the pressure medium from the pressure medium pump to a first working chamber, and a flow of the pressure medium from a second working chamber, acting in the opposite direction to the first working chamber, to the first working chamber.

However, the background of the art always has the disadvantage that with previously known camshaft adjusters that combine the OPA and the CTA adjustment principles, the ratio between the OPA and the CTA adjustment components is predefined by the design of the camshaft adjuster and is solely dependent on the engine properties, such as the oil pressure and the camshaft torques in which the camshaft adjuster is installed. This means that the parts of the OPA and CTA adjustment principle within one adjustment result from the ratio of the oil and the camshaft torque energy. In other words, even with sufficiently large camshaft torques, the sub-chambers are acted upon with hydraulic medium from the pump, even if the energy of the camshaft torques would be sufficient for adjustment.

SUMMARY

It is therefore the object of the disclosure to avoid or at least to mitigate the disadvantages of the prior art. In particular, a camshaft adjuster is to be provided which combines the advantages of the two adjustment principles with one another in a particularly efficient manner. In addition, the camshaft adjuster should be designed to be as energy-saving and space-saving as possible.

This object is achieved according to the disclosure in a generic device in that the control valve has a (first) additional switch position in which a first sub-chamber of the two sub-chambers is connected to the tank and a second sub-chamber of the two sub-chambers is separated or disconnected from the pump. In other words, the object is achieved according to the disclosure by means of a camshaft adjuster designed as a so-called smartphaser, in which a special valve is used in order to be able to implement an OPA and a CTA adjustment principle separately/independently of one another.

This is advantageous in that it makes it possible to perform the adjustment solely through the use of camshaft torques, without hydraulic medium having to be provided by the pump. On the other hand, if the operating point of the engine does not offer sufficiently large camshaft torques for adjustment, such as cylinder deactivation, valve lift reduction, valve deactivation or a changed load on the high pressure pump, adjustment using the OPA principle or a combination of the OPA and the CTA principle can be performed.

Advantageous embodiments are further explained below.

According to an example embodiment, the control valve can have a (second) additional switch position in which the first sub-chamber is separated or disconnected from the pump and the second sub-chamber is connected to the tank. This means that both the A-chamber and the B-chamber can be emptied towards the tank when the pump is blocked due to the two additional switch positions. This enables a pure CTA adjustment on both sides.

According to an example embodiment, the control valve can be designed as a 4/5-way valve which has an A-connection connected to the first sub-chamber, a B-connection connected to the second sub-chamber, a P-connection connected to the pump and a T-connection connected to the tank. This means that the control valve according to the disclosure has two additional switch positions compared to a 4/3-way valve used previously. In these two additional switch positions, the P-connection/P-opening, i.e., the oil supply to a valve piston of the control valve from the pump, is blocked and only the sub-chamber that is to be reduced in size, i.e., relieved of pressure, is connected to the tank.

According to an example embodiment, the control valve can have five switch positions which can be switched as a function of a PWM signal from a control device. In other words, it is only defined by the PWM signal whether an adjustment is performed with the CTA adjustment principle or with a combination of the CTA and the OPA adjustment principle. This means that the decision as to which adjustment principle is used is made by the control unit.

A pressurized hydraulic medium flow can be blocked in the first additional switch position and/or in the second additional switch position. It is particularly advantageous if, in the other switch positions, i.e., a central position and the end positions, the same flow rate is achieved as in a known camshaft adjuster designed as a smartphaser.

According to an example embodiment, the control valve can have a valve sleeve and a piston arranged so as to be axially displaceable in the valve sleeve, wherein the piston comprises four webs. Two webs are positioned in the center and two webs on the outside.

According to an example embodiment, a distance between two axially adjacent webs of the webs of the piston, in particular of the two central webs, can be essentially as large as that of an opening of the valve sleeve connected to the pump, i.e., the P-connection. As a result, the P-connection can be closed as quickly as possible, so that simple switching between the switch positions is facilitated.

Furthermore, it is expedient if a width of an opening of the valve sleeve connected to the pump is essentially as large as that of an overlap of control edges of the piston with an opening of the valve sleeve connected to one of the two sub-chambers. This means that the P-opening in the valve sleeve is essentially as large as the overlap of the control edges of the piston with the A-opening or with the B opening. Thus, when the piston is moved from the regulated position, the P-opening can be quickly closed and the A-opening or the B-opening can be connected to the tank. A sequence control is implemented in this manner.

In an example embodiment, the camshaft adjuster can have a locking mechanism for locking the rotor relative to the stator, in particular in a central position, wherein the locking mechanism is unlocked in an end position of the control valve, in particular with a PWM signal of 100%. Starting from the central position can thus be guaranteed.

BRIEF DESCRIPTION OF THE DRAWINGS

The disclosure is explained below with the aid of drawings. In the figures.

The figures are only schematic in nature and serve only for understanding the disclosure. The same elements are provided with the same reference signs.

DETAILED DESCRIPTION

Figure 1:
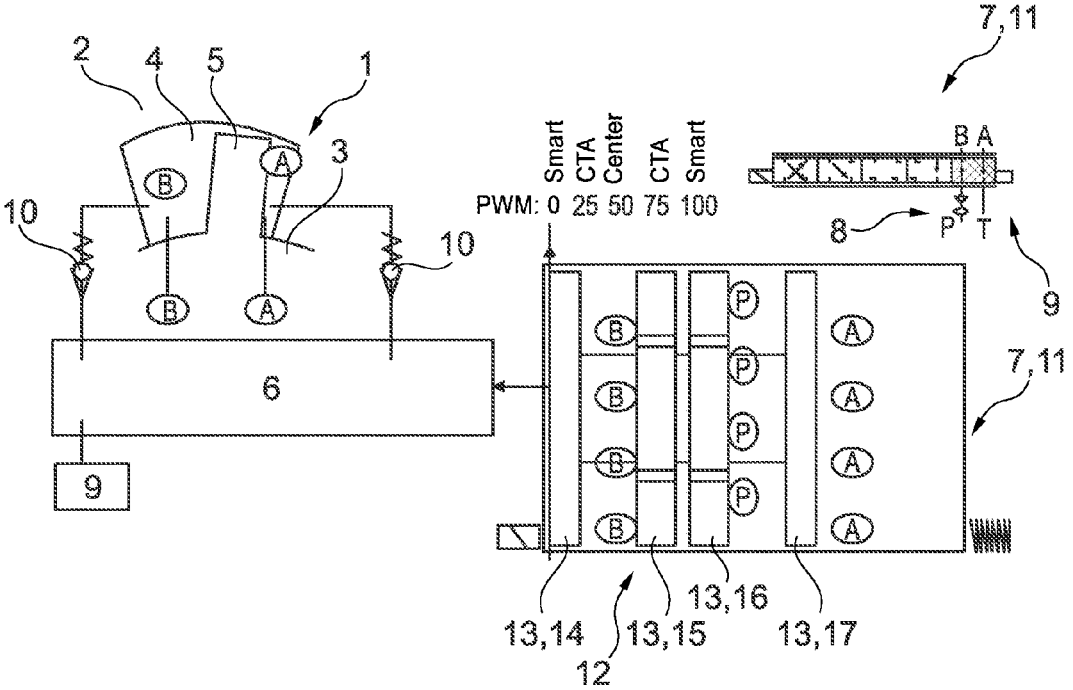
FIG. 1 shows a schematic view of a camshaft adjuster according to the disclosure in a first switch position.

FIGS. 1 to 5 show a camshaft adjuster 1 according to the disclosure in a purely schematic manner. The camshaft adjuster 1 is a camshaft adjuster of the vane type for a motor vehicle drive train. The camshaft adjuster 1 is used for adjusting the phase position of a camshaft relative to a crankshaft. The camshaft adjuster 1 has a stator 2 which is rotatably coupled to the crankshaft and a rotor 3 which is rotatably coupled to the camshaft. The rotor 3 is arranged so as to be rotatable within the stator 2. The stator 2 and the rotor 3 can be rotated relative to one another within a limited angular range. The camshaft adjuster 1 has working chambers 4 formed between the stator 2 and the rotor 3.

The working chambers 4 are each divided by a radially projecting blade 5 of the rotor 3 into two sub-chambers, which are also referred to as A-chamber and B-chamber. The sub-chambers can be pressurized with hydraulic medium in order to adjust the rotor 3 relative to the stator 2. The sub-chambers each act in opposite directions. This means that the rotor 3 can be adjusted relative to the stator 2 in the retard direction by applying pressure to one sub-chamber, for example the A-chamber, and in the advance direction by applying pressure to the other sub-chamber, for example the B-chamber. When a sub-chamber is pressurized, the hydraulic medium is displaced from the other sub-chamber.

The camshaft adjuster 1 has a reservoir 6 connected to the sub-chambers for storing hydraulic medium, in order to supply hydraulic medium from the reservoir 6 to a sub-chamber when a negative pressure is present in one of the sub-chambers.

The camshaft adjuster 1 has a control valve 7 for controlling the hydraulic medium flow. Depending on the switch position of the control valve 7, the A-chamber and the B-chamber can be connected to a pump 8 or a tank 9. The reservoir 6 is connected to the tank 9 so that excess hydraulic medium can drain away. The reservoir 6 is connected to the A-chamber and to the B-chamber via a check valve 10.

The reservoir 6 is supplied with hydraulic medium via the control valve 7. According to the disclosure, the control valve 7 has a switch position in which a first sub-chamber of the two sub-chambers is connected to the tank 9 and a second sub-chamber of the two sub-chambers is separated or disconnected from the pump 8. According to an example embodiment, the control valve 7 also has a switch position in which the second sub-chamber is connected to the tank 9 and the first sub-chamber is separated or disconnected from the pump 8. According to the disclosure there are thus two additional switch positions in the control valve 7, in which the pump 8 is blocked and communication is established between the tank 9 and the sub-chamber to be reduced.

The control valve 7 is designed as a 4/5-way valve 11. The control valve 7 has an A-connection connected to the A-chamber, a B-connection connected to the B-chamber, a P-connection connected to the pump 8 and a T-connection connected to the tank 9. The control valve 7 is controlled between five switch positions by a PWM signal.

FIG. 1 shows the camshaft adjuster 1 in a first switch position of the control valve 7. In the first switch position, the pump 8 is connected to the B-chamber and the A-chamber is connected to the tank 9. In the first switch position, the camshaft adjuster undergoes a smart operation, in which adjustment is performed via a combination of the camshaft torques (CTA principle) and the hydraulic medium pressure (OPA principle). The PWM signal is at 0%.

Figure 2:
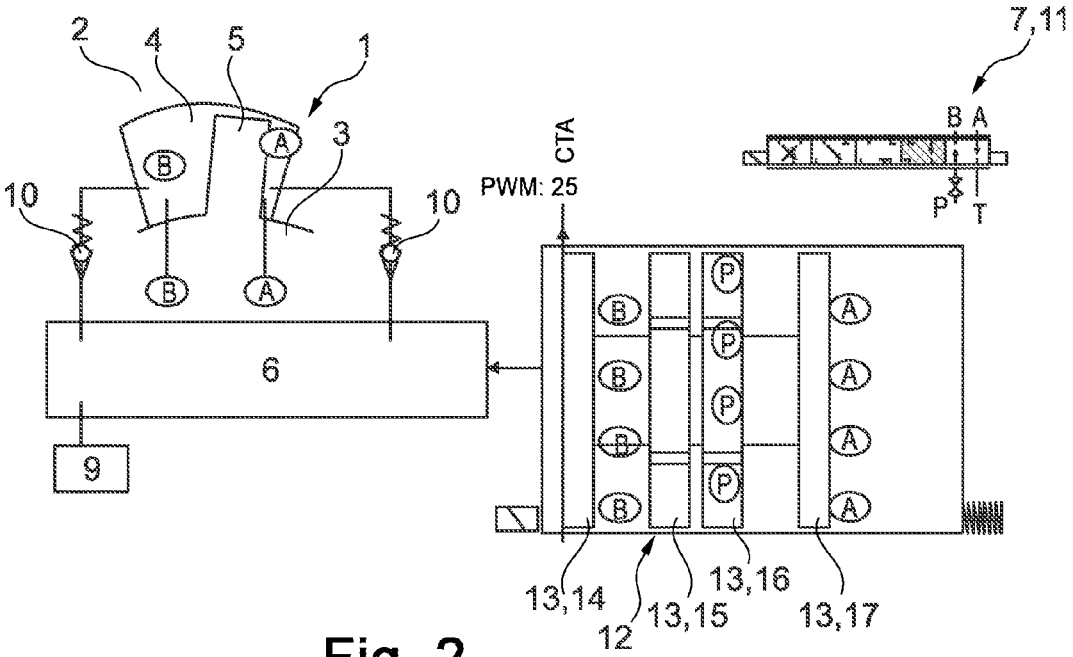
FIG. 2 shows a schematic view of the camshaft adjuster in a second switch position.

FIG. 2 shows the camshaft adjuster 1 in a second switch position of the control valve 7. In the second switch position, the P-connection and the B-connection are blocked and the A-chamber is connected to the tank 9. In the second switch position, the camshaft adjuster 1 is in pure CTA operation, in which adjustment is only performed via the camshaft torques. The PWM signal is at 25%.

Figure 3:
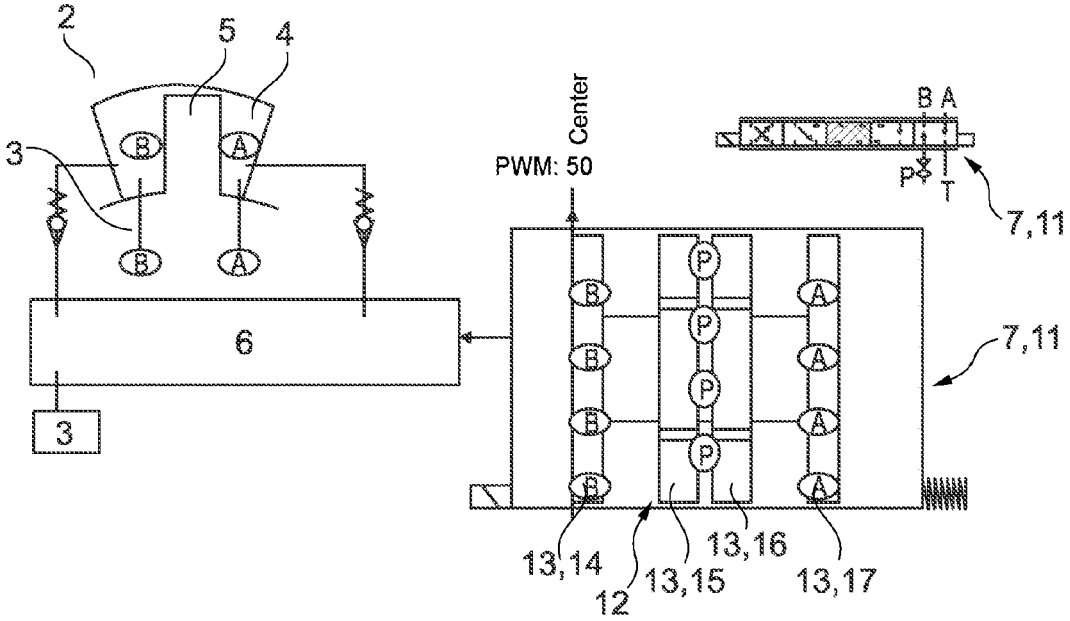
FIG. 3 shows a schematic view of the camshaft adjuster in a third switch position.

FIG. 3 shows the camshaft adjuster 1 in a third switch position of the control valve 7. In the third switch position, a central position compensation is performed. This allows the leakage from the camshaft adjuster 1 to be compensated for. This means the connection between the pump 8 and the A-chamber and the connection between the pump 8 and the B-chamber are slightly opened. A connection between the A-chamber and the tank 9 and a connection between the B-chamber and the tank 9 are blocked. In the third switch position, the camshaft adjuster 1 is in regulated operation. The PWM signal is at 50%.

Figure 4:
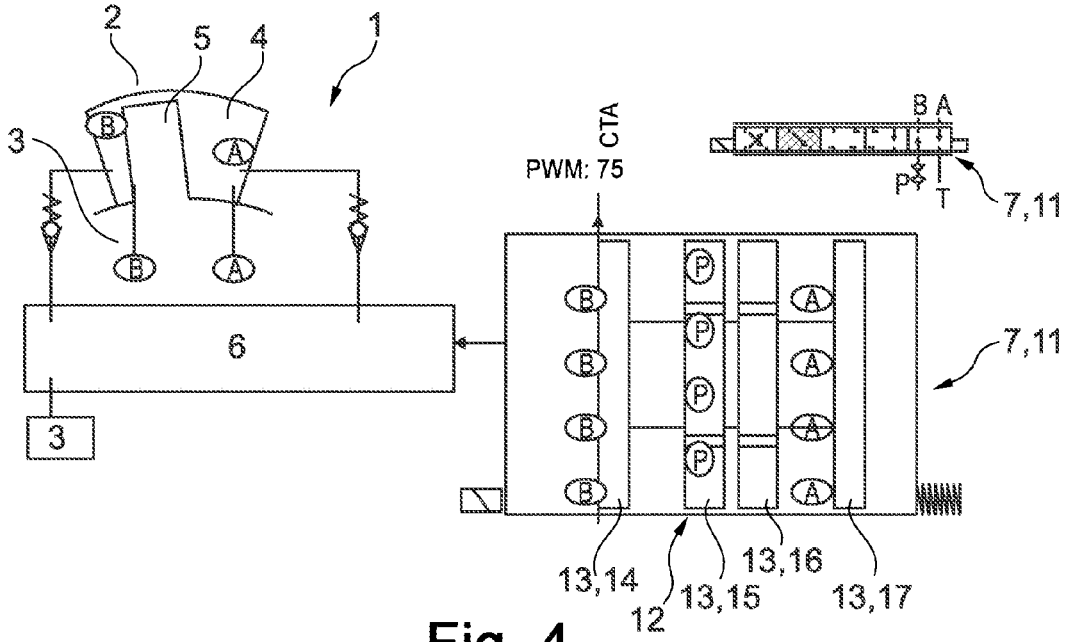
FIG. 4 shows a schematic view of the camshaft adjuster in a fourth switch position.

FIG. 4 shows the camshaft adjuster 1 in a fourth switch position of the control valve 7. In the fourth switch position, the P-connection and the A-connection are blocked and the B-chamber is connected to the tank 9. In the fourth switch position, the camshaft adjuster 1 is in pure CTA operation, in which adjustment is only performed via the camshaft torques. The PWM signal is at 75%.

Figure 5:
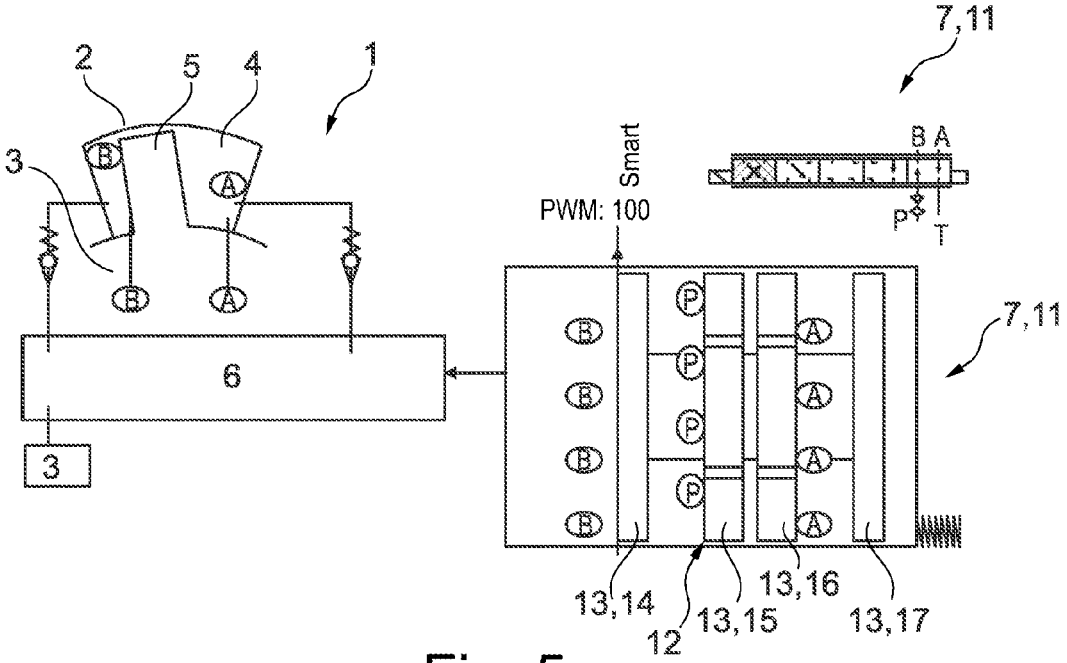
FIG. 5 shows a schematic view of the camshaft adjuster in a fifth switch position.

FIG. 5 shows the camshaft adjuster 1 in a fifth switch position of the control valve 7. In the fifth switch position, the pump 8 is connected to the A-chamber and the B-chamber is connected to the tank 9. In the fifth switch position, the camshaft adjuster undergoes a smart operation, in which adjustment is performed using a combination of the camshaft torques (CTA principle) and the hydraulic medium pressure (OPA principle). The PWM signal is at 100%.

To unlock the camshaft adjuster 1, the PWM signal should be set to 100%. The control valve 7 is then in an end position, which here is the fifth switch position. The A-chamber is then connected to the P-opening and an unlocking is performed.

In FIGS. 1 to 5, the control valve 7 is shown schematically. The control valve 7 has a valve sleeve and a valve piston/piston 12 which is arranged so as to be displaceable in the valve sleeve. The piston 12 is designed in such a way that a sequence control is available. The valve sleeve has P-openings connected to the pump 8, which form the P-connection. The valve sleeve has T-openings connected to the tank 9, which form the T-connection. The valve sleeve has A-openings connected to the A-chamber, which form the A-connection. The valve sleeve has B-openings connected to the B-chamber, which form the B-connection.

The piston 12 has four webs 13. In the first switch position, the B-openings are arranged between a first outer web 14 and a first central web 15, the P-openings are arranged between a second central web 16 and a second outer web 17 and the A-openings are arranged distal to the second outer web 17. The distance between the first central web 15 and the second central web 16 essentially corresponds to the width of the P-openings. The width of the P-openings essentially corresponds to that of an overlap of the control edges of the piston 12 formed by the outer webs 14, 17 with the A-openings or with the B-openings. The P-connection is thus closed before the A-connection or the B-connection (depending on the direction of adjustment) is connected to the tank 9 or the reservoir 6. Thus, the P-opening can be blocked with the piston 12 and the A-opening or B-opening can be opened when switching from the regulated state (50%) to 25% or 75%.

Figure 6:
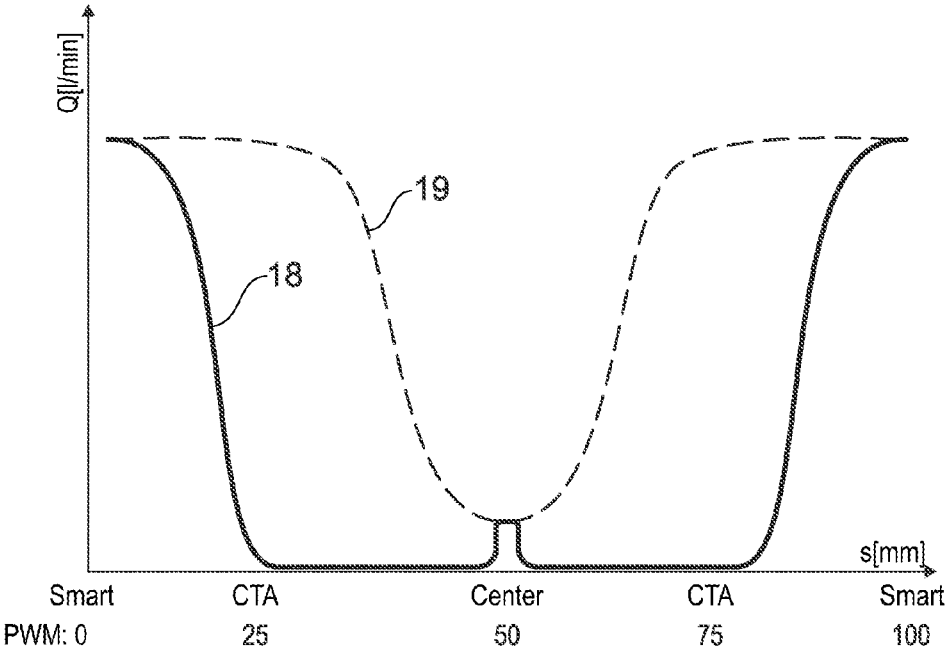
FIG. 6 shows a graph representing a relationship between a hydraulic medium flow and the switch positions.

FIG. 6 shows a flow 18 of the camshaft adjuster 1 according to the disclosure in comparison with a flow 19 of a known (smartphaser) camshaft adjuster. In the first, third and fifth switch positions, the flows 18, 19 are equal. In the second and fourth switch positions, the pump 8 is blocked, so that the flow 18 of the camshaft adjuster 1 is equal to zero.

LIST OF REFERENCE SYMBOLS

1 Camshaft adjuster
2 Stator
3 Rotor
4 Working chamber
5 Vane
6 Reservoir
7 Control valve
8 Pump
9 Tank
10 Check valve
11 4/5-way valve
12 Piston
13 Web
14 First outer web
15 First central web
16 Second central web
17 Second outer web
18 Flow
19 Flow

The invention claimed is:

1. A vane type camshaft adjuster configured for a motor vehicle drive train, the vane type camshaft adjuster comprising:

a stator, a rotor arranged to rotate relative to the stator, working chambers formed between the stator and the rotor, each working chamber divided into two sub-chambers by a radially projecting blade of the rotor, and a reservoir connected to the two sub-chambers, the reservoir configured for storing hydraulic medium so that hydraulic medium can be supplied from the reservoir to any one of the two sub-chambers when a negative pressure is present in the any one of the two sub-chambers to adjust the rotor relative to the stator, and the two sub-chambers are configured to be connected to either a pump or a tank according to a switch position of a control valve of the camshaft adjuster, and in a first additional switch position of the control valve, a first sub-chamber of the two sub-chambers is configured to drain to the tank and a second sub-chamber of the two sub-chambers is disconnected from the pump.

2. The vane type camshaft adjuster according to claim 1, wherein in a second additional switch position of the control valve, the first sub-chamber is disconnected from the pump and the second sub-chamber is configured to drain to the tank.

3. The vane type camshaft adjuster according to claim 2, wherein a pressurized hydraulic medium flow is blocked at least in the first additional switch position or in the second additional switch position.

4. The vane type camshaft adjuster according to claim 1, wherein the control valve is configured as a 4/5-way valve having an A-connection connected to the first sub-chamber, a B-connection connected to the second sub-chamber, a P-connection connected to the pump and a T-connection connected to the tank.

5. The vane type camshaft adjuster according to claim 4, wherein the control valve has five switch positions obtained via a PWM signal.

6. The vane type camshaft adjuster according to claim 1, wherein:

the control valve has a valve sleeve and a piston arranged so as to be axially displaceable in the valve sleeve, and the piston comprises four webs.

7. The vane type camshaft adjuster according to claim 6, wherein a distance between two axially adjacent webs of the four webs of the piston is essentially as large as that of an opening of the valve sleeve connected to the pump.

8. The vane type camshaft adjuster according to claim 6, wherein a width of an opening of the valve sleeve connected to the pump is essentially as large as an overlap of control edges of the piston with an opening of the valve sleeve connected to one of the two sub-chambers.

9. The vane type camshaft adjuster according to claim 6, wherein the piston is configured such that it has a sequence control.

10. The vane type camshaft adjuster of claim 1, wherein the control valve has at least four switch positions.

11. The vane type camshaft adjuster of claim 1, wherein the control valve has five switch positions.

12. A vane type camshaft adjuster configured for a motor vehicle drive train, the vane type camshaft adjuster comprising:

a stator, a rotor arranged to rotate relative to the stator, working chambers formed between the stator and the rotor, each working chamber divided into a first sub-chamber and a second sub-chamber by a radially projecting blade of the rotor, a reservoir connected to the first and second sub-chambers, the reservoir configured to store hydraulic medium so that hydraulic medium can be supplied from the reservoir to one of the first or second sub-chambers when a negative pressure is present in the one of the first or second sub-chambers to adjust the rotor relative to the stator, and a control valve having a piston configured to be displaceable to five switch positions, and in a first switch position of the control valve:

the first sub-chamber is configured to be connected to a tank, and the second sub-chamber is configured to be connected to a pump, and in a second switch position of the control valve:

the first sub-chamber is configured to be connected to the tank, and the second sub-chamber is configured to be blocked from the pump, and in a third switch position of the control valve, the first sub-chamber is configured to be connected to the pump, and the second sub-chamber is configured to be connected to the pump, and in a fourth switch position of the control valve, the first sub-chamber is configured to be blocked from the pump, and the second sub-chamber is configured to be connected to the tank, and in a fifth switch position of the control valve, the first sub-chamber is configured to be connected to the pump, and the second sub-chamber is configured to be connected to the tank.

13. The vane type camshaft adjuster of claim 12, wherein the piston comprises four webs.

14. A vane type camshaft adjuster configured for a motor vehicle drive train, the vane type camshaft adjuster comprising:

a stator, a rotor arranged to rotate relative to the stator, working chambers formed between the stator and the rotor, each working chamber divided into a first sub-chamber and a second sub-chamber by a radially projecting blade of the rotor, a reservoir connected to the first and second sub-chambers, the reservoir configured to store hydraulic medium so that hydraulic medium can be supplied from the reservoir to one of the first or second sub-chambers when a negative pressure is present in the one of the first or second sub-chambers to adjust the rotor relative to the stator, and a control valve having a piston configured to be displaceable to five switch positions, and in three switch positions, at least one of the first or second sub-chambers is configured to be connected to a pump, and in two switch positions, at least one of the first or second sub-chambers is configured to be disconnected from the pump and a remaining one of the first or second sub-chambers is configured to be connected to a tank.

15. The vane type camshaft adjuster of claim 14, wherein:

in one of the two switch positions, the first sub-chamber is configured to be connected to a tank, and the second sub-chamber is configured to be disconnected from a pump, and in a remaining one of the two switch positions, the first sub-chamber is configured to be disconnected from the pump, and the second sub-chamber is configured to be connected to the tank.

16. The vane type camshaft adjuster of claim 15, wherein in a first one of the three switch positions, the first sub-chamber is configured to be connected to the tank, and the second sub-chamber is configured to be connected to the pump.

17. The vane type camshaft adjuster of claim 16, wherein in a second one of the three switch positions, the first and second sub-chambers are configured to be connected to the pump.

18. The vane type camshaft adjuster of claim 17, wherein in a third one of the three switch positions, the first sub-chamber is configured to be connected to the pump, and the second sub-chamber is configured to be connected to the tank.

19. The vane type camshaft adjuster of claim 14, further comprising:

a first check valve arranged between the reservoir and the first sub-chamber, and a second check valve arranged between the reservoir and the second sub-chamber.

20. The vane type camshaft adjuster of claim 19, wherein the reservoir is configured to be connected to the tank.

* * * * *